United States Patent [19]

Erickson

[11] Patent Number: 4,628,544

[45] Date of Patent: Dec. 16, 1986

[54] SERVER GAUNTLET

[76] Inventor: Joyce A. Erickson, 324 Cherrywood Ct., Vernon Hills, Ill. 60061

[21] Appl. No.: 724,772

[22] Filed: Apr. 18, 1985

[51] Int. Cl.[4] ..... A41D 19/00

[52] U.S. Cl. ..... 2/158; 2/161 R

[58] Field of Search ..... 2/16, 20, 158, 164, 2/160, 161 R, 159

[56] References Cited

U.S. PATENT DOCUMENTS

| | | | |
|---|---|---|---|
| D. 258,625 | 3/1981 | Sheridan | 2/16 |
| 338,790 | 3/1886 | Slack | 2/159 X |
| 720,640 | 2/1903 | Torrens | 2/161 R |
| 1,206,102 | 11/1916 | Gibson | 2/159 |
| 1,509,060 | 9/1924 | Dodge | 2/159 X |
| 2,304,137 | 12/1942 | Peakes | 2/164 X |
| 2,314,922 | 3/1943 | Chanut | 2/159 |
| 2,735,108 | 2/1956 | Cremer | 2/158 |
| 2,810,131 | 10/1957 | Kogut | 2/158 |
| 2,889,556 | 6/1959 | Mehler | 2/158 |
| 2,905,946 | 9/1959 | Goldsmith | 2/16 X |
| 2,937,379 | 5/1960 | Mackay et al. | 2/158 |
| 3,096,523 | 7/1963 | Bruchas | 2/159 |
| 3,327,320 | 2/1968 | Forsyth | 2/158 |

*Primary Examiner*—Louis K. Rimrodt

*Attorney, Agent, or Firm*—Jack L. Uretsky

[57] ABSTRACT

A server gauntlet includes a mitt-like member with an attached extended portion for covering a forearm. The gauntlet is provided with a reflective, heat resistant lining for protection of the hand and forearm. The outer surface of the extended portion and grasping surface of the mitt-like member are provided with non-skid material so that hot dishes and the like may be carried on the forearm and in the hand without slipping.

4 Claims, 5 Drawing Figures

FIG. 1
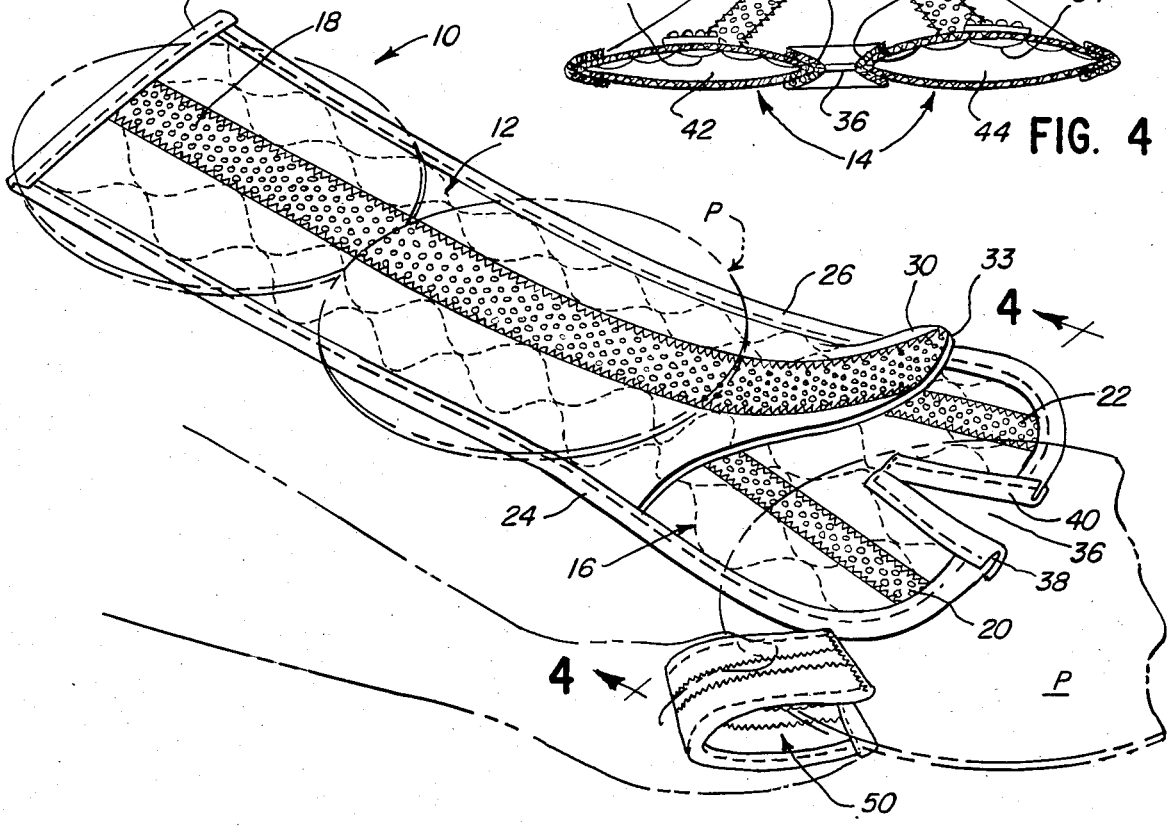
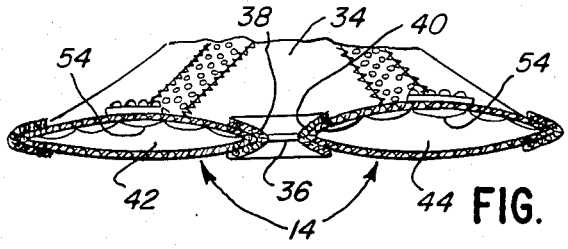
FIG. 4
FIG. 2
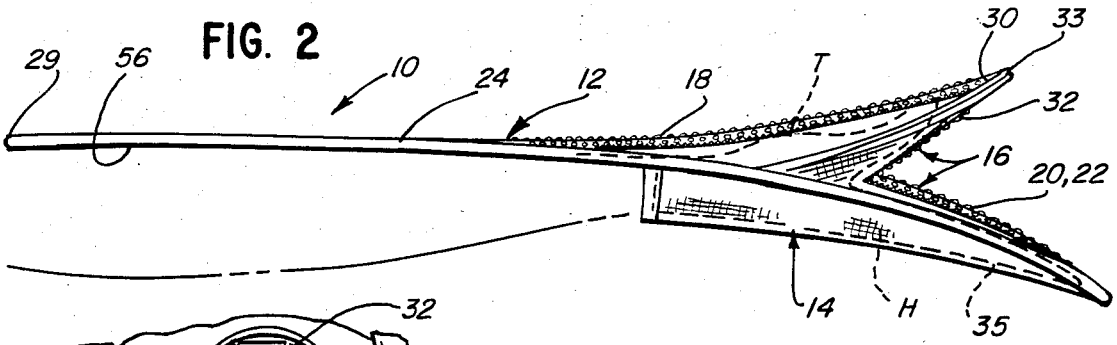
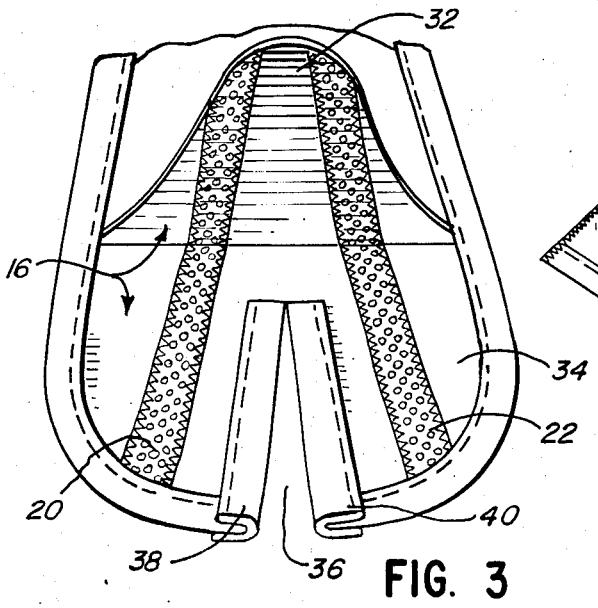
FIG. 3
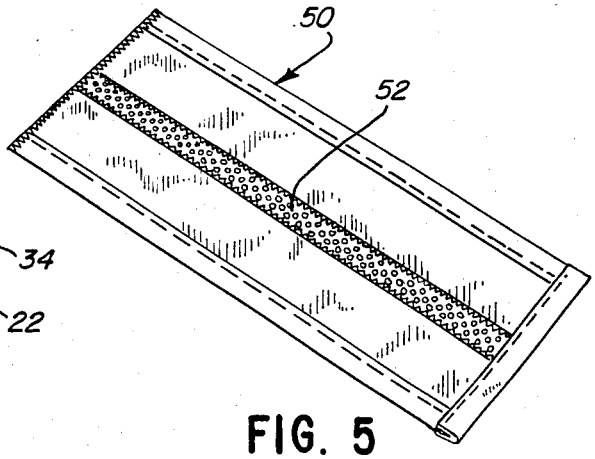
FIG. 5

SERVER GAUNTLET

BACKGROUND OF THE INVENTION

Serving personnel in restaurants, such as waiters and waitresses, are often required to serve very hot or cold food simultaneously to several customers. The serving personnel may do less walking and reduce customer waiting time by carrying several dishes at one time, carrying some of the dishes on their arms. The dishes carried are often hot, and burned arms frequently result.

Arm protective gloves, or gauntlets, have long been known. R. W. Peakes, U.S. Pat. No. 2,304,137 discloses a glove with an arm protective portion, a protective inner liner, and an outer glove. D. M. Sheridan, U.S. Pat. No. Des. 258,625 discloses a design for a heat protective arm and hand glove for hot food service. The Sheridan disclosure shows a glove of the kind that has separated thumb and first finger portions, and an extended portion for covering an arm.

Gloves such as those disclosed in Sheridan, while they may be of some use in protecting arms of restaurant service personnel from burns, may be inconvenient to use in restaurants because dishes and trays may readily slip off of the surface of the gloves, particularly from the extended arm-covering portions. Also, such gloves are designed to fit only a right or a left hand, and may accordingly be inconvenient to use because they cannot be easily transferred from one hand to another.

Ambidextrous hot-server mittens are also known. One such mitten, which is available from R. A. Briggs & Co., Lake Zurich, IL 60047 and Cannon, Cannon, NY 10020, comprises a mitt portion which provides a single pocket for enclosing the four fingers of a hand, engaged to a thumb-containing opposed enclosure. The mitt portion extends just above the wrist of an adult human hand, and the entire mitten, except for the rear side, that is the side covering the back of the hand, is protected by a heat-protective inner liner.

It would be desirable to have a heat-protective arm and hand glove, suitable for use in serving hot foods, which is ambidextrous, and which is not subject to the inconvenience of having plates and the like readily slip off.

SUMMARY OF THE INVENTION

A protective, grip-enhancing and arm protective gauntlet for protectively facilitating manual transfer of temperature discomforting objects, such as a plurality of food-ladened plates, may comprise a mitt member, a thumb protective member, a forearm protective member and means for enhancing frictional contact between the gauntlet and the hot objects.

The mitt member includes a hand-receiving opening for receiving an inserted hand and protectively covering the front of such a hand. The thumb protective member defines an enclosure for receiving an inserted thumb and protectively covering the front grasping surface of the thumb. The thumb protective member engages with the mitt member to form a mitt covering the palm and thumb of the hand. The forearm protective member will generally have an engagement end that is engaged with the mitt member, the engagement being adjacent to the hand-receiving opening of the mitt member. The other, or terminal, end of the forearm protective member will be spaced from the engagement end so that the member provides a protective covering for covering the inner surface of a forearm. The thumb protective member will generally be symmetrically positioned and opposed to the mitt member in order to facilitate ambidextrous use of the gauntlet.

When a hand is inserted into the gauntlet and held outstretched in a palm-up position, the forearm protective member is disposed along the upper forearm. The upper surface of the forearm protective member is provided with means for enhancing frictional contact. Hot dishes disposed upon the forearm protective member will accordingly ride upon the forearm without slipping off or burning the arm.

It is an object of the present invention, therefore, to provide a grip-enhancing gauntlet for covering a hand and forearm during use in serving temperature discomforting objects, the gauntlet being resistant to slippage of plates and trays.

One feature of the present invention is a provision for ambidextrous use of such grip-enhancing covering.

Another feature of the present invention is the provision of a mitt member that is adapted for lateral spreading of fingers under carried plates and trays.

These and other objects, advantages, and features of the invention will become readily apparent from the following detailed description of one construction of a preferred embodiment, which is presented in conjunction with the accompanying drawings.

BRIEF DESCRIPTION OF THE DRAWINGS

FIG. 1 illustrates a grip-enhancing gauntlet exemplifying features of the present invention in a top perspective view showing hot plates on the arm portion of the gauntlet and a plate being removed from the grasping portion of the gauntlet with the help of an auxiliary pad.

FIG. 2 illustrates a side elevational view of the gauntlet illustrated in FIG. 1 in place on a human arm, the arm being illustrated with the palm of the hand turned upwards and the thumb positioned in opposition to the center of the palm.

FIG. 3. illustrates a front elevation of the gauntlet in place on a human arm as is illustrated in FIG. 2.

FIG. 4 illustrates a front cross-sectional perspective view of the mitt member of the gauntlet illustrated in FIG. 1.

FIG. 5 is a perspective view from above of the auxiliary pad illustrated in FIG. 1, showing the grasping surface of the pad.

DETAILED DESCRIPTION OF A PREFERRED EMBODIMENT

As is illustrated in FIGS. 1 and 2, an exemplary construction of a protective, grip-enhancing and arm-protective gauntlet 10 embodying features of the present invention preferably is comprised of a tapered-ended, approximately rectangular, elongated forearm panel 12, an approximately rectangular hand panel 14, a palm panel 16 and non-skid stripes 18, 20, 22.

The forearm panel and hand panel are engaged along transverse edges 24, 26 to define a sleeve portion with an insertable hand-receiving opening 28. The opening 28 is suitable for insertingly receiving a hand that is thrust into the sleeve portion from the rearward direction, as is illustrated in FIG. 2. The forearm panel 12 extends from a free end 29 to forwardly of the sleeve portion defined by the engaged edges 24, 26. The forearm panel 12 symmetrically and transversely, with respect to a longitudinal axis, narrows forwardly of the sleeve portion for approximately the length of a human thumb to provide a tapered end 30.

The palm panel 16 is provided with an end portion 32 which is shaped to match the tapered end 30 of the forearm panel 12. The end portion 32 of the palm panel is disposed on the lower surface of the tapered end 30, the respective edges of the tapered end of the forearm panel and end portion of the palm panel being mutually engaged along a seam 33. An adjacent remainder portion 34 (illustrated in FIG. 3) of the palm panel 16 is shaped and arranged on the upper surface of the hand panel 14 for mutual engagement of the edges of the remainder portion 34 of the palm panel 16 and the forward extremity 35 of the hand panel 14, as shown in FIG. 2.

The hand panel 14, palm panel 16 and forearm panel 12 accordingly cooperate to provide a protective mitt member or covering for the palm and fingers of a human hand H, shown in FIG. 2. The fingers of the hand H fit within the mitt member comprising the remainder portion 34 of the palm panel 16 and the forward extremity 35 of the hand panel 14. The thumb of the hand H fits within a thumb protective member comprising the tapered end 30 of the forearm panel 12 and the end portion 32 of the palm panel 16. The thumb protective member is symmetrically positioned between the lateral edges 24, 26 and opposed so as to place the thumb in gripping opposition to the fingers within the mitt member in order to enable ambidextrous use of the gauntlet 10. The tapered end 30 comprises an engagement end of the forearm panel 12, which is engaged with the mitt member adjacent the hand-receiving opening 28. The free end 29 of the forearm panel 12 provides a terminal end substantially longitudinally spaced from the end engaged with the mitt member to provide a protective covering for the inner forearm of either arm of a user.

An arm protecting gauntlet for carrying a plurality of hot plates and the like may accordingly comprise: an approximately rectangular forearm panel having an upper side and a lower side, the length of the panel being sized to extend from below the wrist to above the inner elbow of an adult human arm, a first end of the elongated rectangle symmetrically transversely narrowing for approximately the length of an adult human thumb to provide a tapered end, and the lower side of the forearm panel being reflectively heat resistant; an approximately rectangular hand panel having substantially the width of said forearm panel, the hand panel being disposed on the lower side at the first end of the forearm panel, the transverse edges of the forearm and hand panels being engaged to provide a sleeve portion, the hand panel being longitudinally arranged to provide a portion extending beyond the tapered end of the forearm panel, the hand panel being dimensioned to encompass an adult human hand; a palm panel disposed on the lower surface of the forearm panel and having an end portion shaped to match the tapered end of the forearm panel and edgewise engaged to the tapered end, a generally rectangular remainder portion, the palm panel lower side being reflectively heat resistant, the engaged tapered ends defining a thumb receiving enclosure or pocket sized to hold a thumb of a human hand with the remainder portion protectively covering the palm of the hand; and friction means for preventing slippage of the hot plates and the like, the friction means being disposed on and engaged to the upper side of the forearm panel and the upper side of the palm panel.

It has been discovered that heavy plates are carried more easily if provision is made for lateral spreading of the fingers to balance the shifting weight of the plates. The remainder portion 34 of the palm panel 16 and the hand panel 14 are accordingly slit longitudinally from the front with a transversely centered slit 36 which runs longitudinally for approximately the length of an adult human middle finger. The palm panel remainder portion 34 and hand panel 14 are engaged along the edges 38, 40, of the slit 36. The tapered end 30 of the forearm panel 12 is approximately opposed to the slit 36.

The engaged split palm panel and hand panel provide a pair of enclosures 42, 44, as may be seen in FIG. 4, each enclosure suitable for insertion of two fingers of a hand. The slit 36 accordingly enables lateral movement of the fingers as is desirable for balancing plates and like objects.

The non-skid material 18, 20, and 22 may comprise a flexible, or resilient, rubberoid type of material formed in strips, for example a material sold under the trademark "Safety Tred," which is available from Dritz, Spartanburg, SC 29304. A single strip 18 of such a non-skid material has a lateral width which is sized to fit within the width of the tapered end 30 of the forearm panel 12. The strip 18 is disposed longitudinally along the upper surface of the forearm panel 12 and is engaged to the forearm panel, as by stitching. The non-skid strips 20 and 22 are similarly engaged to the external surface of the palm panel 16. The strips 20, 22 are disposed symmetrically along the length of the upper surface of the palm panel 16, on either side of, and approximately parallel to, the slit 36.

An auxiliary non-skid hand pad 50 is also provided for cooperative use with the protective gauntlet 10 of the present invention. The auxiliary pad 50 may comprise a rectangular hot pad having a non-skid strip 52 longitudinally disposed on one surface, as is illustrated in FIG. 5.

The undersurface of the forearm panel 12 and of the palm panel 16 are lined with insulating material 54. In the specific construction illustrated in FIG. 4, the insulating material comprises metallic ironing-board - potholder fabric, which is reflectively heat resistant, available from Minnesota Fabrics, Inc., District Office No. 3, Main Street Plaza, 266 East Geneva Rd., Wheaton, IL 60187. Any convenient, preferably flame-retardant, fabric will serve as the upper covering of the respective palm and forearm panels 12, 16. Non-skid material 56 may also be placed on the underside of the forearm panel 12, as may be seen from FIG. 2, to avoid slippage of the forearm panel on the upper arm.

The exemplary construction described herein includes a forearm panel 12 that is about 17" long, of which about 2½" comprises the tapered end 30, and about 6" wide, except for the tapered end. The hand panel 14 is approximately 8¾" by 6", and is positioned to extend about 1¾" forwardly of the tapered end 30 of the forearm panel 12. The palm panel 16 is appropriately sized to fit with the forearm panel 12 and hand panel 14. The non-skid strip 18 is about 2" wide. The strips 20, 22 are each about ⅜" wide and spaced and angled with adjacent edges about ⅝" apart at the outer longitudinal extremity of the end portion 32 and about 2¾" apart at the outer longitudinal extremity of the remainder portion 34 of the palm panel 16. The slit 36 extends longitudinally about 3½" from the longitudinally forward extremity of the mitt member.

It will, of course, be understood that modification of the present invention in its various aspects will be apparent to those skilled in the art, some being apparent only after study and others being a matter of routine design. For example, the present invention does not require the use of any particular insulating material although the metallic material from Minnesota Fabrics, Inc. has been mentioned for exemplary purposes. Further, the use of the particular components described herein merely exemplify a construction of one embodiment of the basic invention. It is not, therefore, a necessary feature of the invention that the non-skid material on the forearm panel be disposed in a single strip, or that the panels be shaped and arranged as described herein. Nor is it a necessary feature of the invention that the mitt member be provided with any particular number of slits, or any slits at all. Accordingly, the scope of the invention herein should not be limited by, or to, the particular embodiment or specific construction herein described, but should be defined only by the appended claims and equivalents thereof.

What is claimed is:

1. A protective grip-enhancing gauntlet for protectively facilitating manual transport of temperature discomforting objects, such as a plurality of food laden plates, said covering comprising, in combination:

a mitt member having a hand-receiving opening for insertingly receiving a hand, for protectively covering the front of a hand, said mitt member being split to provide two enclosures, each enclosure being suitable for insertion of two fingers of a hand, and the enclosures being laterally moveable with respect to each other, and said mitt member including a palm-covering portion engaged with means for enhancing frictional contact between said mitt member and a temperature discomforting object;

a thumb protective member defining a thumb receiving enclosure for protectively covering the frontal grasping surface of a thumb, said thumb protective member being engaged with said mitt member;

a forearm protective member having an engagement end engaged with said mitt member adjacent said hand-receiving opening, said forearm protective member having a terminal end spaced longitudinally away from said engagement end to provide a protective covering for covering an inner forearm; and means engaged with said forearm protective member and extending longitudinally along the upper surface of said forearm protective member substantially from said engagement end to said terminal end and then to the distal extremity of said thumb protective member, respective separate strips of said means extending along the outer surfaces of said two enclosures of said mitt-member, said means being suitable for enhancing frictional contact between said grip-enhancing gauntlet and surfaces of the temperature discomforting objects.

2. A gauntlet as in claim 1 wherein said thumb protective member is symmetrically positioned and opposed for gripping engagement with respect to the mitt member to enable ambidextrous use of the gauntlet.

3. A gaunlet as in claim 1 in combination with a hot pad having engaged means for enhancing frictional contact, said hot pad enabling the loading and unloading of temperature discomforting dishes and the like with one hand from another hand and arm encased in said gauntlet.

4. An arm protecting gauntlet for carrying a plurality of hot plates and the like comprising:

an approximately rectangular forearm panel having an upper side and a lower side, the length of said panel being sized to extend from below the wrist to above the inner elbow of an adult human arm, a first end of said elongated rectangle symmetrically transversely narrowing for approximately the length of an adult human thumb to provide a tapered end, and the lower side of said forearm panel being reflectively heat resistant;

an approximately rectangular hand panel having substantially the width of said forearm panel, said hand panel being disposed on the lower side at said first end of said forearm panel, the transverse edges of said forearm and hand panels being engaged to provide a sleeve portion, said hand panel being longitudinally arranged to provide a portion extending beyond said tapered end of said forearm panel, said hand panel being dimensioned to encompass an adult human hand;

a palm panel disposed on the lower surface of said forearm panel and having an end portion shaped to match said tapered end of said forearm panel and edgewise engaged to said tapered end, a generally rectangular remainder portion, and said palm panel lower side being reflectively heat resistant, the engaged tapered ends defining a thumb receiving pocket sized to hold a thumb of a human hand with said remainder portion protectively covering the palm of said hand; and friction means for preventing a slippage of the hot plates and the like, said friction means being disposed on and engaged to the upper side of said forearm panel and the upper side of said palm panel, said hand panel and said palm panel being longitudinally split to provide separately movable finger enclosures.

* * * * *